US005668559A

United States Patent [19]

Baro

[11] Patent Number: 5,668,559

[45] Date of Patent: Sep. 16, 1997

[54] ANTENNA FOR PORTABLE RADIO DEVICES

[75] Inventor: José Baro, Taverny, France

[73] Assignee: Alcatel Mobile Communication France, Paris, France

[21] Appl. No.: 322,799

[22] Filed: Oct. 13, 1994

[30] Foreign Application Priority Data

Oct. 14, 1993 [FR] France ..... 93 12226

[51] Int. Cl.[6] ..... H01Q 1/24; H01Q 1/36

[52] U.S. Cl. ..... 343/702; 343/895; 343/752

[58] Field of Search ..... 343/895, 702, 343/749, 901, 752, 841; H01Q 1/24, 1/36

[56] References Cited

U.S. PATENT DOCUMENTS

| | | | |
|---|---|---|---|
| 2,982,964 | 5/1961 | Bresk et al. | 343/895 |
| 3,283,332 | 11/1966 | Nussbum | 343/895 |
| 3,573,840 | 4/1971 | Gouillou et al. | 343/895 |
| 3,852,759 | 12/1974 | Felsenheld et al. | 343/895 |
| 4,121,218 | 10/1978 | Irwin et al. | 343/895 |
| 4,169,267 | 9/1979 | Wong et al. | 343/895 |
| 4,543,581 | 9/1985 | Nemet | 343/702 |
| 4,868,576 | 9/1989 | Johnson, Jr. | 343/702 |
| 4,890,114 | 12/1989 | Egashira | 343/702 |
| 5,317,325 | 5/1994 | Bottomley | 343/895 |
| 5,329,287 | 7/1994 | Strickland | 343/895 |
| 5,335,366 | 8/1994 | Daniels | 343/702 |

FOREIGN PATENT DOCUMENTS

| | | |
|---|---|---|
| 0511577A3 | 11/1992 | European Pat. Off. . |
| 810325 | 3/1937 | France . |
| 1183143 | 12/1964 | Germany . |
| 861229 | 2/1961 | United Kingdom . |

*Primary Examiner*—Hoanganh T. Le

*Attorney, Agent, or Firm*—Sughrue, Mion, Zinn, Macpeak, and Seas

[57] ABSTRACT

The present invention concerns an antenna for portable radio devices including a helical antenna coupled at the base to a transmitter/receiver. The pitch of a conductive material helix constituting the helical antenna varies according to the height of the helix. It decreases from the base of the helical antenna towards its top.

20 Claims, 5 Drawing Sheets

FIG. 3A
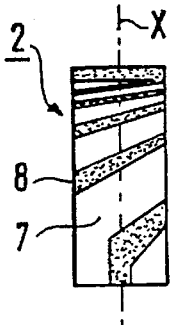
FIG. 3B
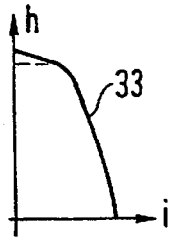
FIG. 4
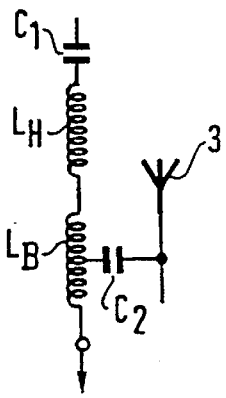
FIG. 5
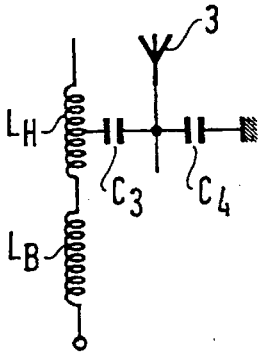
FIG. 6A
PRIOR ART
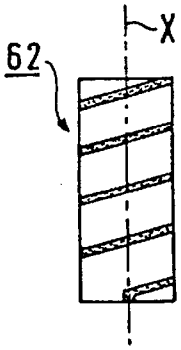
FIG. 6B
PRIOR ART
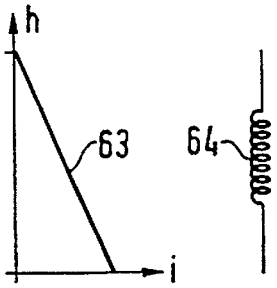
FIG. 6C
PRIOR ART
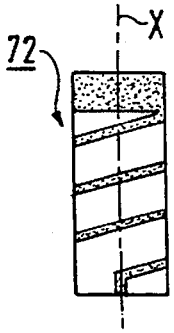
FIG. 7A
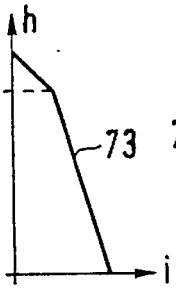
FIG. 7B
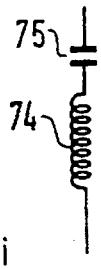
FIG. 7C
FIG. 8B
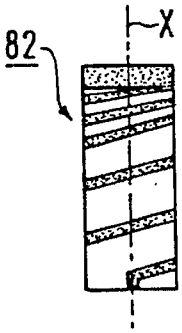
FIG. 8A
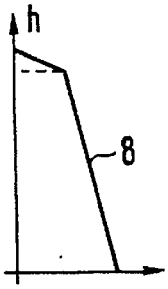
FIG. 8C
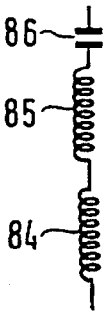

ANTENNA FOR PORTABLE RADIO DEVICES

BACKGROUND OF THE INVENTION

1. Field of the Invention

The present invention concerns an antenna for portable radio devices and in particular for mobile telephones, a method of manufacturing an antenna of this kind and a portable radio device including an antenna of this kind. The antenna is used to transmit and to receive radio signals.

2. Description of the Prior Art

The antennas currently used in portable radio devices, and more particularly in mobile telephones, usually include:

a quarter-wave helical antenna in the upper part of the telephone casing and fed by a coaxial line coupled to the transmitter/receiver of the radio device for use under normal conditions, the helix usually comprising a metal wire wound around an insulative material former, optionally, for using the radio device in the presence of strong interference, a half-wave whip retractable from the casing of the radio device and such that when it is retracted inside the casing it is virtually entirely decoupled from the helical antenna and when it is deployed from the casing it is capacitively coupled to the helical antenna.

Antennas of this kind are described in patent application EP-A-0 367 609 and in U.S. Pat. No. 4,121,218.

Although the radio performance of such antennas is acceptable for this application it is not optimized, in particular in terms of bandwidth and efficiency. This is because their radio impedance, characteristic of their radiating power and consequently of their efficiency as antennas, is low (in practise very much lower than 50 Ω).

Also, given the currently relatively small size of portable mobile telephones, it is desirable to make the retractable whip as small as possible so as to take up as little space as possible inside the casing of the telephone, in which it is housed when retracted. The volume occupied inside the casing by the retractable whip cannot be occupied by other components necessary for the operation of the mobile telephone (transmitter/receiver, modulator/demodulator, encoder/decoder, smartcard connector, etc).

Prior art retractable whips are usually substantially cylindrical and as a result occupy too great a volume within the mobile telephone casing.

Further, the performance of this prior art type antenna using a retractable whip in terms of gain and omnidirectionality is degraded by the interdependence of the retractable whip and the mobile telephone casing.

Consequently, one object of the present invention is to provide an antenna for portable radio devices of increased efficiency as compared with prior art antennas of this type.

Another object of the present invention is to provide an antenna of the above type which occupies the smallest possible volume within the portable device.

A further object of the present invention is to provide an antenna of the above type in which the retractable whip is as independent as possible of the casing of the associated radio device.

SUMMARY OF THE INVENTION

To this end the present invention consists in an antenna for portable radio devices including a helical antenna coupled at its base to a transmitter/receiver, wherein the pitch of a conductive material helix constituting said helical antenna varies according to the height of the helix, decreasing from the base of said helical antenna to its top.

Other features and advantages of the present invention emerge from the following description of embodiments of an antenna in accordance with the invention shown and described by way of purely illustrative and non-limiting example.

BRIEF DESCRIPTION OF THE DRAWINGS

FIG. 3A is a diagrammatic representation of the helical antenna from FIG. 1 and FIG. 3B is a graph showing the current as a function of the height from the base of the helix.

FIG. 4 is an equivalent circuit of the antenna from FIG. 1 when the retractable whip is retracted.

FIG. 5 is an equivalent circuit of the antenna from FIG. 1 when the retractable whip is deployed.

FIG. 6A is a schematic representation of a conventional helical antenna, FIG. 6B is a graph showing the current as a function of the height from the base of the helix and FIG. 6C is the equivalent circuit of the antenna.

FIG. 7A is a diagrammatic representation of a varying pitch helical antenna of constant width in accordance with the invention, FIG. 7B is a graph showing the current as a function of the height from the base of the helix and FIG. 7C is the equivalent circuit of the antenna.

FIG. 8A is a diagrammatic representation of another varying pitch constant width helical antenna of the present invention, FIG. 8B is a graph showing the current as a function of the height from the base of the helix and FIG. 8C is the equivalent circuit of the antenna.

DETAILED DESCRIPTION OF THE PREFERRED EMBODIMENTS

Components shown in more than one figure are always identified by the same reference number.

Figure 1:
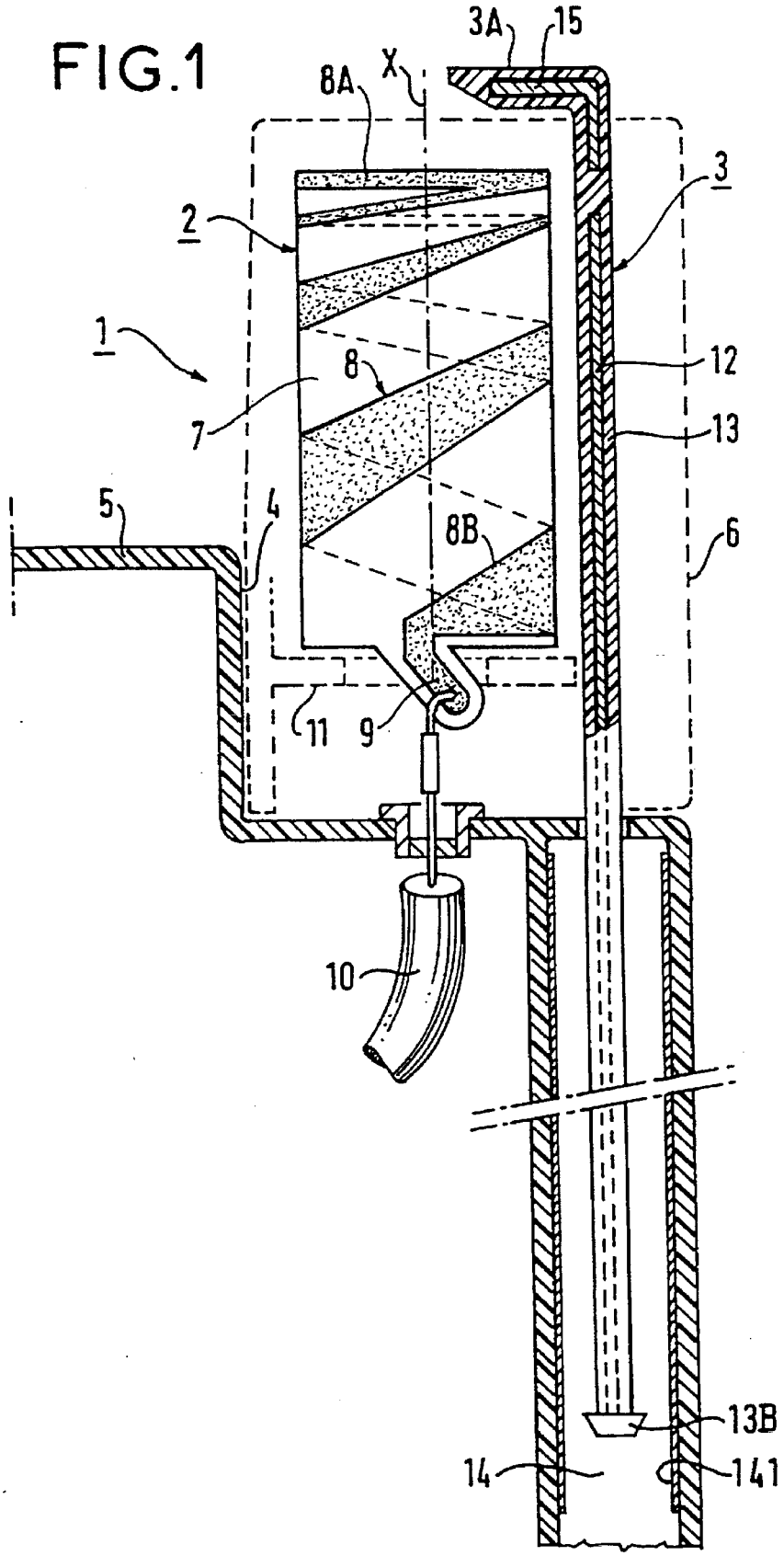
FIG. 1 shows, partly in cross-section, a portion of a mobile telephone in which an antenna of the invention is installed.

Refer first to FIG. 1.

This figure shows an antenna 1 of the invention. The antenna 1 comprises a helical antenna 2 and a retractable whip 3.

Part of the helical antenna 2 is housed in a recess 4 in a mobile telephone casing 5, part of which is shown in FIG. 1. The casing 5 is made from an insulative material, possibly metal-coated, and is substantially parallelepiped shape. An antenna casing 6 (shown in chain-dotted outline) whose base fills the recess 4 holds and protects the helical antenna 2.

The helical antenna 2 is entirely inserted into the antenna casing 6 and approximately three quarters of its height projects out of the mobile telephone casing 5.

It comprises a substantially cylindrical insulative material former 7 onto the outside of which a helix 8 is deposited using a conventional metal deposition process. In accordance with the invention the pitch of the helix 8 varies, decreasing from its base 8B to its top 8A. Also in accordance with the invention, the width of the electrical track constituting the helix 8 also varies, decreasing from the base 8B to the top 8A. The reasons for this construction and the advantages obtained by it are explained below.

The electrical length of the helix 8 is substantially equal to one-quarter the average wavelength used.

The base 8B of the helix 8, being at the base of the former 7, is connected by a connecting tab 9 to a coaxial cable 10 feeding the helical antenna 2 in the mobile telephone casing 5 and also connected to the transmitter/receiver of the latter (not shown).

The antenna casing 6 also contains an insulative material locating ring 11 (shown in chain-dotted outline) for centering and holding the helical antenna 2.

Figure 2:
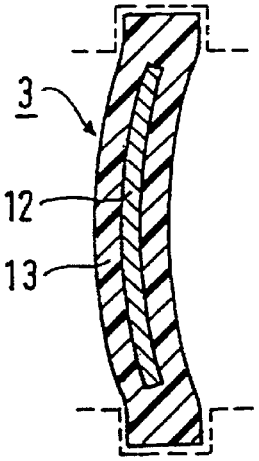
FIG. 2 is a transverse cross-sectional view of the retractable whip shown in FIG. 1.
Figure 9:
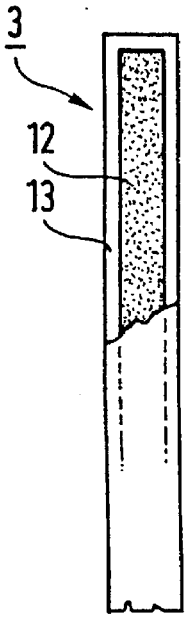
FIG. 9 is a front view in partial cross-section of the retractable whip of the antenna from FIG. 1.

The retractable whip 3 is made from a metal strip 12 with a very flat C-shape cross-section (see FIGS. 2 and 9). The electrical length of the "flat" strip 12 is substantially equal to half the average wavelength used. The strip 12 is protected by an insulative material covering 13.

The retractable whip 3 advantageously further comprises a metal member 15 at its top 3A, this member 15 extending in a direction substantially orthogonal to the axis X of the helix 8 (the strip 12 extends in a direction substantially parallel to the axis X). The member 15 is also enclosed within the covering 13 and is optionally connected electrically to the strip 12. Its purpose is described below.

The retractable whip 3 can operate in either of two positions. In a first position (shown in FIG. 1) it is virtually entirely retracted within the antenna casing 6 and within a suitable housing 14 in the mobile telephone casing 5. In this position the antenna 1 is of the quarter-wave type (i.e. it uses the casing 5 as the ground plane) and only the helical antenna 2 transmits and receives radio signals. The walls of the housing 14 have a metal coating 141 to provide a shield for the retractable whip 3 when retracted.

In a second position (not shown) the retractable whip 3 is entirely deployed outside the antenna casing 6. Because of capacitive coupling between the whip 3 and the top of the helical antenna 2, the total height of the antenna 1 and its radiation resistance are increased. In this position of the retractable whip 3 the antenna 1 is still of the quarter-wave type.

To limit the deployment travel of the retractable whip 3 the bottom end 13B of the covering 13 is frustoconical in shape with its larger diameter end facing towards the top of the antenna. The end 13B abuts against the top wall 14A of the housing 14.

As mentioned above, an essential feature of the invention is that the pitch of the helical antenna varies, decreasing towards the top, i.e. as the theoretical current in a prior art (constant pitch and width) helical antenna of the same size decreases. This construction improves the efficiency of the antenna 1 by providing improved energy transfer and increasing its bandwidth.

This design produces a substantially trapezoidal distribution of the current in the helical antenna 2. This increases the radiation resistance of the antenna and consequently its efficiency and its bandwidth.

In the example shown in FIG. 1 the turns of the helix 8 are in contact with each other at the top 8A so that a continuous metal-plated surface is obtained at the top 8A. This makes the top 8A capacitive, procuring the substantially trapezoidal distribution of current and the resulting advantages. Immediately before the top 8A the turns of the helix 8 are closely spaced but not in contact with each other. The resulting capacitance is thereby rendered inductive, which increases its apparent value. Also, the provision of a capacitance at the top of the helical antenna 2 facilitates and improves the capacitive coupling and matching between the latter and the retractable whip 3.

The varying pitch helix thus achieves optimal matching and coupling in both operating modes (whip in or out).

FIG. 6A shows in a highly schematic form a prior art helical antenna 62 with constant pitch and width. The graph 63 in FIG. 6B shows the current i as a function of the height h along the axis X of the helical antenna 62. Note that the distribution of the current i is substantially triangular. FIG. 6C shows the equivalent circuit of the antenna 62: this antenna is equivalent to a pure inductance 64.

FIG. 7A shows in highly schematic form a helical antenna 72 of the present invention which can be used instead of the helical antenna 2 from FIG. 1. The turns of the antenna 72 are in contact with each other at the top in order to constitute a continuous metal coating. The graph 73 in FIG. 7B shows the current i as a function of the height h along the X axis. Note that the current distribution is tending towards a trapezoidal shape. FIG. 7C shows the equivalent circuit of the antenna 72, which is equivalent to an inductor 74 in series with a capacitor 75.

FIG. 8A shows in highly schematic form a helical antenna 82 of the present invention which can be used instead of the helical antenna 2 from FIG. 1. The turns of the antenna 82 are in contact with each other at the top to constitute a continuous metal coating and closely spaced but not in contact with each other immediately below the top. The remainder of the helix has a constant pitch. The graph 83 in FIG. 8B shows the current i as a function of the height h along the X axis. Note that the current distribution shows an increased tendency (as compared with FIG. 7B) towards a trapezoidal shape. FIG. 8C shows the equivalent circuit of the antenna 82 which is equivalent to a first inductor 84 (representing the constant pitch part of the helix) in series with a second inductor 85 (representing the closely spaced part of the helix) and with a capacitor 86 (representing the top of the helix where the turns are in contact with each other).

An advantageous improvement to the present invention further increases the radiation resistance of a helical antenna like that shown in FIG. 7A or FIG. 8A, i.e. increases its Q, by optimizing the width of the electrical track constituting the helix in order to increase the surface area defined by the current distribution. This further improves the efficiency and the bandwidth of the antenna of the invention.

The helical antenna 2 shown in FIG. 1 illustrates the principles just explained. It is shown diagrammatically in FIG. 3A and FIG. 3B shows the graph of the current i as a function of the height along the X axis. Note that the surface area between the graph 33 and the coordinate axes is further increased relative to the corresponding surface area in FIG. 7B or FIG. 8B. The effect of this is to increase the radiation resistance and therefore the efficiency and the bandwidth of the antenna.

FIGS. 4 and 5 show the equivalent circuit of the antenna 1 respectively with the retractable whip 3 retracted and deployed.

In FIG. 4:

$C_1$ represents the cumulative capacitance added by the metal member 15 at the top 3A of the retractable whip 3 and by the capacitive part of the top 8A of the helix 8; the part of $C_1$ corresponding to the metal member 15 of the whip 3 complements the effect of the capacitive top 8A of the helix 8, $L_H$ represents the high inductance due to the closely spaced turns immediately below the top 8A of the helix 8, $L_B$ represents the low inductance of the lower part of the helix 8 ($L_B$ is negligible in comparison with $L_H$), $C_2$ is a stray capacitance in the lower part of the helix 8 and is negligible given that $L_B$ is very small in comparison with $L_H$.

In FIG. 5, the part of $C_1$ due to the metal member 15 at the top 3A of the retractable whip 3 no longer has any effect when the whip 3 is deployed and the part of $C_1$ due to the top 8A of the helix 8 is included in the capacitor $C_3$ coupling the retractable whip 3 to the helical antenna 2; this coupling is high and tends to reduce the effect of $L_H$, which compensates for the capacitor $C_4$ added by the whip 3 when deployed and corresponding to the antenna effect of the whip 3 relative to the external environment.

Increasing the height of the antenna 1 by deploying the retractable whip 3 increases the efficiency of the antenna, in the conventional way, by increasing its effective height and its radiation resistance.

Note that the retractable whip 3 is not necessarily outside the helical antenna 2; if the former is hollow, the retractable whip can be inside the former 7, which has the advantage of saving more space.

Figure 10:
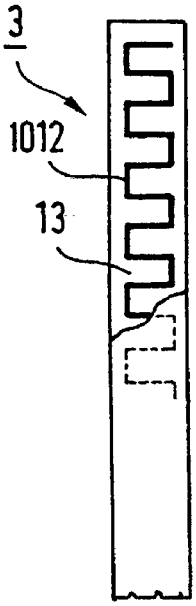
FIG. 10 is a front view in partial cross-section of a first variant of the retractable whip of the antenna from FIG. 1 inside its protective coating.
Figure 11:
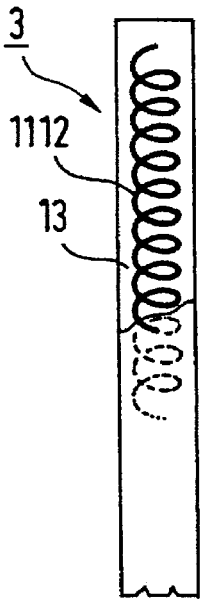
FIG. 11 is a front view in partial cross-section of a second variant of the retractable whip of the antenna from FIG. 1 inside its protective coating.
Figure 12:
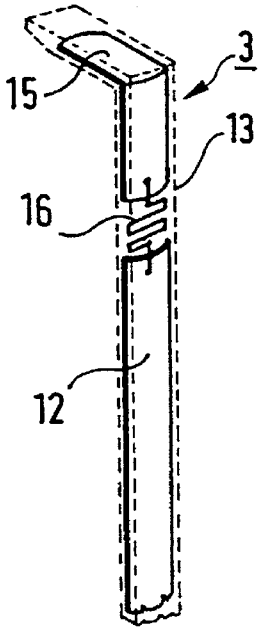
FIG. 12 is a perspective view of a variant of the retractable whip from FIG. 9.

FIGS. 10 and 11 shows variants of the retractable whip 3.

To be more precise, FIG. 10 shows a variant which can be used instead of the strip 12 of the retractable whip 3 from FIGS. 1, 2 and 9 (the metal member 15 is not shown in FIG. 10). Instead of using a metal strip 12, a metallic conductive line 1012 is deposited onto an insulative material film constituting part of the covering 13 to form a crenellated line. The line 1012 is buried in the covering 13. This shortens the effective length of the retractable whip 3 whilst retaining an electrical length equal to half the wavelength. This reduces the space occupied by the retractable whip 3 inside the mobile telephone casing 5. As with the strip 12, the metal member 15 at the top of the whip 3 can be used to obtain the same effect as previously described.

In another variant of the retractable whip 3, shown in FIG. 11 (the metal member 15 is not shown in these figures, but can also be used in conjunction with the variant shown therein), the strip 12 is replaced by a metal wire 1112 having a crushed spring structure producing an overlapping tile effect with no contact between the turns.

The spring 1112 is also buried in an insulative material covering 13 and the advantages it procures are the same as those obtained with the line 1012.

All these designs of retractable whip 3 (strip 12, line 1012, spring 1112) reduce to a greater or lesser degree the overall size of the retractable whip 3 inside the mobile telephone casing 5, to leave more room for other essential components thereof. The insulative material of the covering 13 is selected to make the whip 3 flexible and to offer sufficient mechanical strength to protect the metal part it encloses.

One way to improve the retractable whip 3, especially suitable when using the strip 12, is to connect the upper metal part of the whip 3, immediately before the capacitive metal member 15, to the latter through an inductive structure 16. This improves the efficiency of the retractable whip 3 in the deployed position.

The manufacture of a helical antenna of the invention is now described in more detail.

As already mentioned, all variants of the helical antenna 2 can be made by depositing metal onto a former 7. The helix can be obtained by any conventional method (metalization followed by silkscreen printing, metalization followed by masking and photolithography, by the method described in patent application EP-A-0 465 658, etc).

The helix can be formed on the outside surface of an insulative material former, or on its inside surface if it is tubular. If the helix 8 is formed on the outside surface of the former 7 (as shown in FIG. 1), the metalization is preferably covered with a protective covering (not shown).

If the inside of the former is metalized, the former wall thickness is preferably small, to facilitate possible capacitive coupling with a retractable whip. Moreover, it may be necessary to stiffen the resulting helical antenna by inserting an insulative material strengthening member into the former.

The proposed method of forming the helix 8 by metalization is advantageous in that the helical antenna 2 can then be very compact, occupying the least possible volume inside the mobile telephone casing 5. Also, the helix made in this way is more reproducible than if a wound wire is used.

Also, the use of this method in the context of the invention is particularly advantageous as it facilitates the formation of a helix of varying pitch and width. Obviously a helix of this kind can be produced using a wound metal wire, but this would be much more complicated.

Figure 14A:
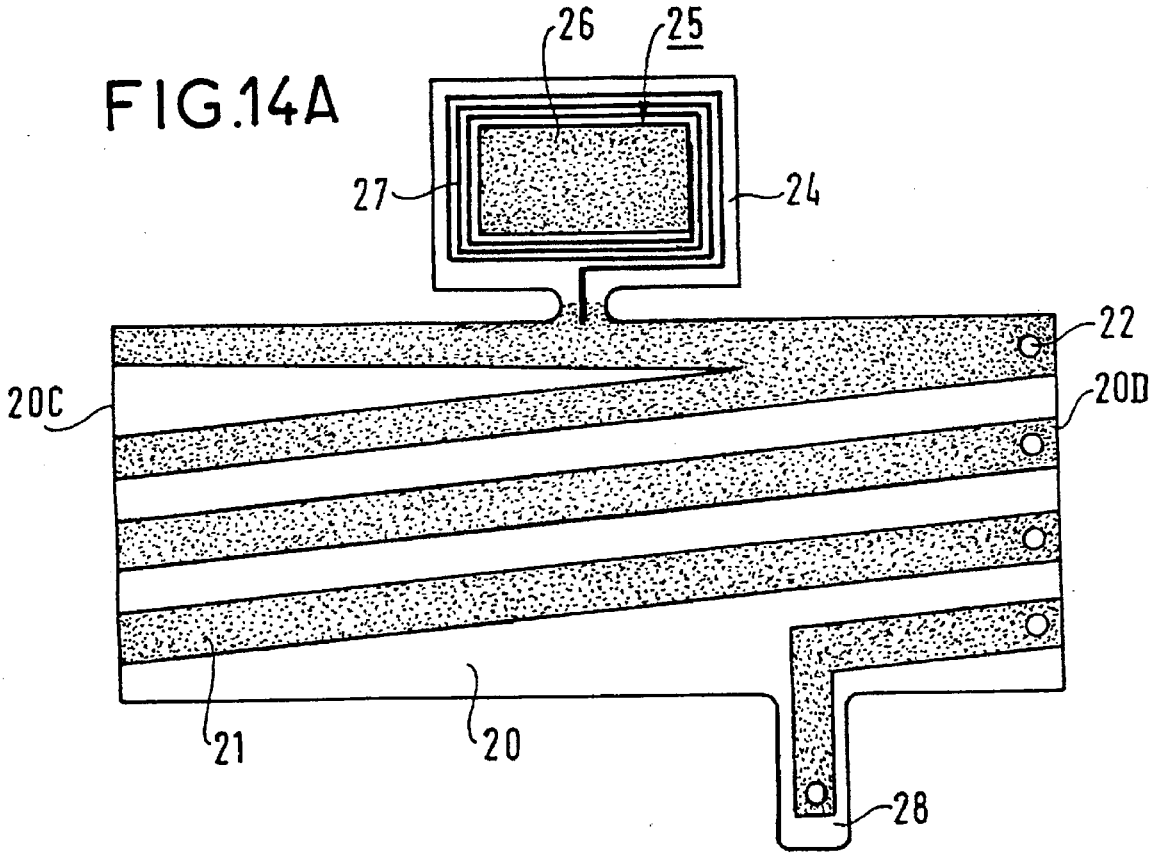
FIG. 14A shows the result of one step of one method of manufacturing a helical antenna like that from FIG. 1.

In one variant of the method of the invention for manufacturing the helical antenna, rather than depositing metal directly onto a former of the required shape, metal is deposited onto a flat and flexible insulative film 20 (see FIG. 14A). The flexible film 20 can be a film of Kapton, Mylar or Duroid (registered trademarks). Its shape is the developed shape of the final shape required for the helical antenna. The unwanted parts of the metalization are then eliminated by silkscreen printing, photolithography or the like to obtain a pattern 21 which produces a helix of the required pitch and length on joining together the opposite edges 20C and 20D of the film 20.

For this purpose the film 20 incorporates metal vias 22 and metalized lands 23 around the vias 22 on the side opposite that carrying the pattern 21 (see FIG. 14B) to provide electrical continuity.

Figure 14B:
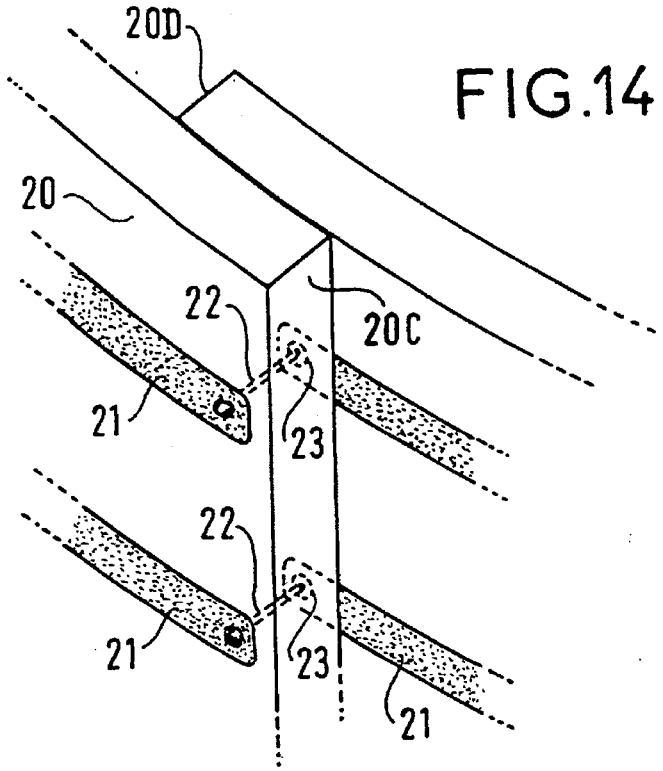
FIG. 14B shows how the FIG. 14A structure is assembled.
Figure 15:
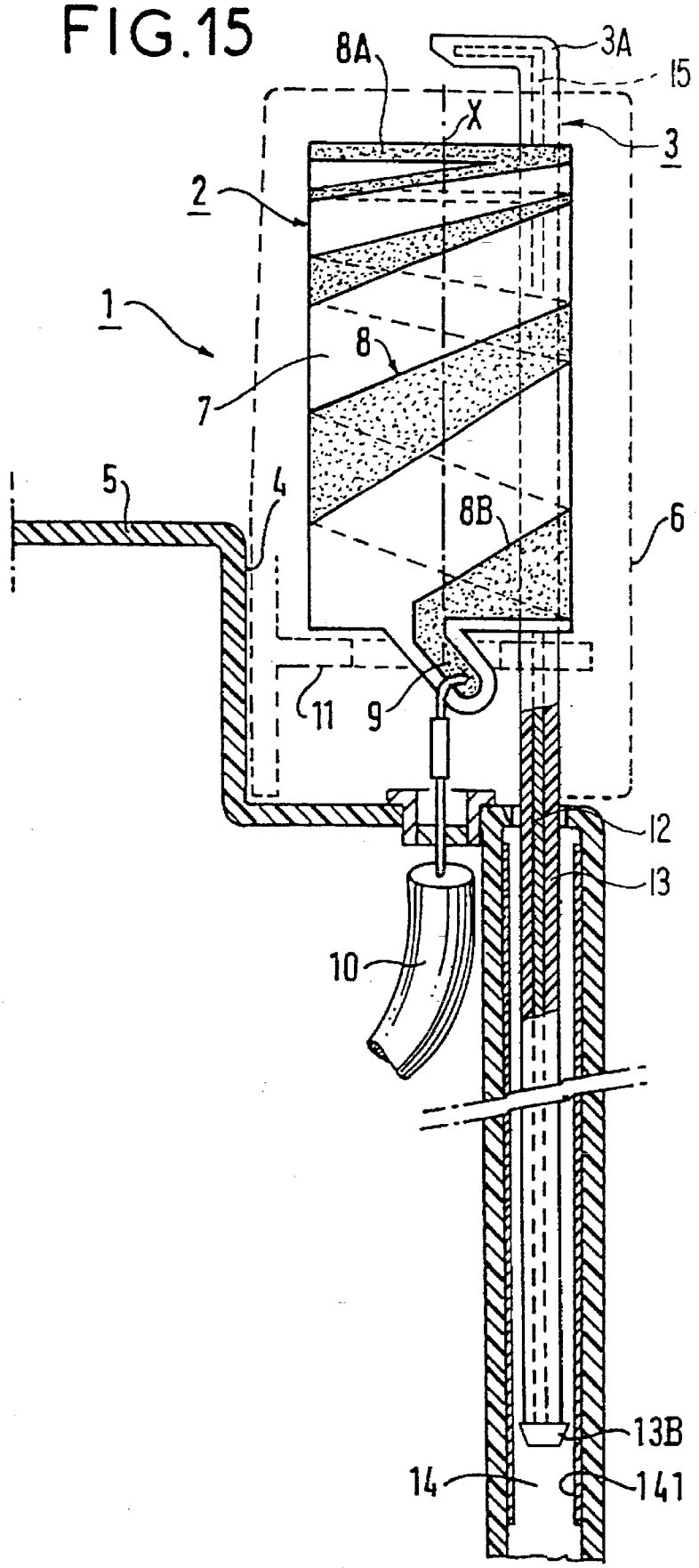
FIG. 15 is like FIG. 1, but shows the whip inside the helix.

The film 20 is welded to a former (not shown) of the required shape (see FIG. 14B).

This method has the advantage of being easier to implement (it is much simpler to deposit metal onto a flat surface than onto the surface of a solid of revolution) and caters for any shape of helical antenna (frustoconical, cylindrical, rectangular cross-section, etc).

FIG. 14A shows that the film 20 has at the top a rectangular "lug" 24 whose surface area is less than that of the film 20, on which there is a metalized pattern 25 having a solid central part 26 surrounded by a spiral 27. The lug 24 is bent at right angles when assembling the film 20 into a parallelepiped shape with rounded corners. The solid central part 26 then constitutes the capacitive top of the helical antenna and the spiral then constitutes the high inductance part.

If only a capacitance at the top is required (cf. FIG. 7A), then the lug 24 can be entirely coated with solid metalization.

The tab 28 at the bottom of the film 20 is used to make the lug connected to the coaxial feed cable.

All variants of the antenna of the invention described above feature a coaxial cable feed, the coaxial cable being connected to the helical antenna and to the transmitter/receiver of the mobile telephone with which the antenna of the invention is associated.

Figure 13A:
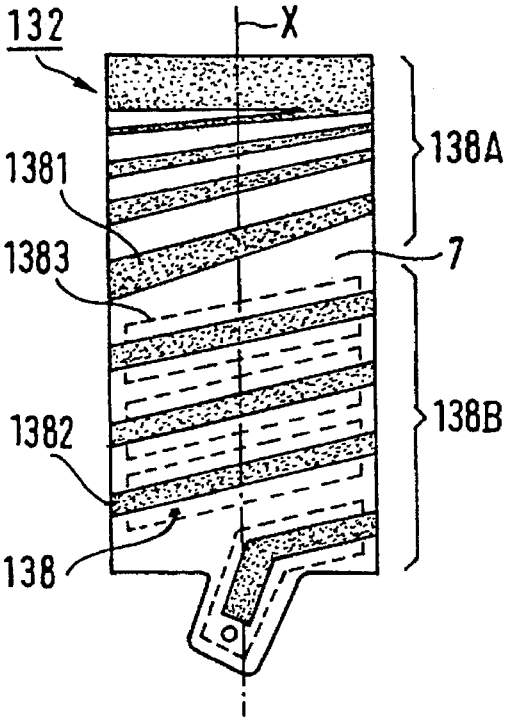
FIG. 13A is a front view of a variant of the helical antenna from FIG. 1.
Figure 13B:
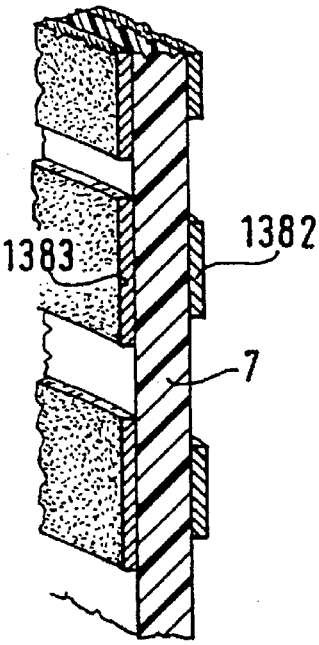
FIG. 13B is a view in cross-section of the wall of the helical antenna from FIG. 13A.

The antenna of the invention can be fed in other ways. For example, FIGS. 13A and 13B show one possible variant of the helical antenna 2 from FIG. 1. Here the helix 138 has two portions 138A and 138B. The portion 138A comprises metalization 1381, on the outside surface of the former 7, for example, whose width and pitch vary to produce a capacitive top and a high inductance, as in FIG. 1. The part 138B has metalization 1382 on the outside surface extending the metalization 1381 but having a constant pitch and width, and a corresponding metalization 1383 on the inside surface of the (tubular) former 7 facing and wider than the metalization 1382.

The electrical length of the portion 138A is approximately one quarter-wavelength, as is that of the portion 138B.

Figure 13C:
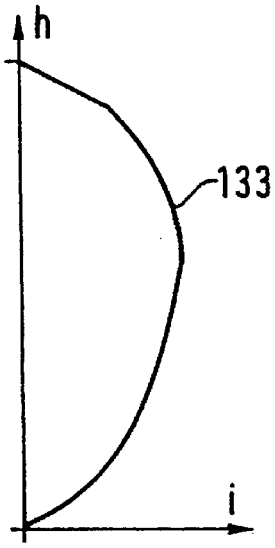
FIG. 13C is a graph showing the current as a function of the height from the base of the helix of the antenna from FIG. 13A.

The graph 133 showing the current i as a function of the height h along the X axis for the helical antenna 132 is shown in FIG. 13C.

The bottom part of the helical antenna 132 is both a radiating element (metalizations 1381 and 1382 forming a coaxial member) and a coaxial cable feed line (1382 and 1383), the metalization 1383 corresponding to the outer ground conductor, i.e. the outer conductor of the feed coaxial cable, and the metalization 1382 corresponding to the central core of the feed coaxial cable (if the metalization 1381–1382 is on the inside of the former 7, the metalization 1383 is naturally on the outside).

The helical antenna in FIGS. 13A and 13B can be manufactured by any of the methods previously described. The antenna 132 can also be made by winding, although this is much more difficult.

The invention is obviously not limited to the embodiments Just described.

In particular, an antenna of the invention does not necessarily include any retractable whip. A whip of this kind is needed only to enable the antenna to operate in all conditions, and this specification does not always apply.

Also, the disposition of the antenna of the invention relative to the mobile telephone casing adopted here is Just one example. Others are feasible without departing from the scope of the invention.

Using a metalization process to manufacture the helical antenna of the invention also facilitates the formation of circuits with distributed or lumped constants at the top of the antenna, or additional impedance correcting components.

It is to be understood that the essential feature of the invention is a helix having a varying pitch, the pitch increasing towards the top of the helical antenna.

All the embodiments of the helical antenna and the retractable whip shown and described are shown and described by way of example only and other embodiments will suggest themselves to those skilled in the art without departing from the scope of the invention.

Finally, without departing from the scope of the invention any means as described can be replaced by equivalent means.

There is claimed:

1. An antenna for a portable radio device including a helical antenna coupled at its base to a transmitter/receiver, wherein the pitch of a conductive material helix constituting said helical antenna varies according to the height of the helix, decreasing from the base of said helical antenna to its top, and wherein the electrical length of said helix is substantially equal to one quarter-wavelength.

2. The antenna according to claim 1 wherein the turns of said helix at the top of said helical antenna are in contact with each other to form a continuous conductive material surface so that said top is capacitive.

3. The antenna according to claim 2 wherein the turns of said helix immediately before said capacitive top are very close together without being in contact with each other in order to produce an inductance higher than that of the remainder of the helix.

4. The antenna according to claim 2 wherein a bottom portion of said helix has a constant pitch.

5. The antenna according to claim 1 wherein said helix is made from a conductive material wire whose width decreases from the base of said helical antenna to its top.

6. The antenna according to claim 1 wherein said helix constitutes at its top a circuit with distributed or lumped constants.

7. The antenna according to claim 1 including, in addition to said helical antenna, a half-wave retractable whip mounted on said device and adapted to be capacitively coupled to said helical antenna when deployed and to be decoupled from said helical antenna when retracted, the lengthwise direction of said whip being substantially parallel to the axis of said helix.

8. The antenna according to claim 7 wherein said retractable whip has a conductive material top end whose length is short compared to that of said whip.

9. The antenna according to claim 8 wherein said metallic top end is orthogonal to the lengthwise direction of said whip and is electrically connected to said whip by an inductive portion, the whole being inserted into an insulative material covering.

10. The antenna according to claim 7 wherein said whip comprises a flat section conductive material strip and is inserted into an insulative material covering.

11. The antenna according to claim 7 wherein said whip is made from a flexible insulative material film into which is inserted a conductive line forming a crenellated structure.

12. The antenna according to claim 7 wherein said whip is made from an insulative material flexible film into which is inserted a conductive wire having the shape of a crushed spring.

13. The antenna according to claim 7 wherein said retractable whip is inside the helix forming said helical antenna.

14. The antenna according to claim 7 wherein said retractable whip is outside the helix forming said helical antenna.

15. The antenna according to claim 7 wherein said retractable whip is entirely surrounded by a metal shield when retracted into said radio device.

16. The antenna according to claim 1, wherein said helical antenna has a substantially trapezoidal distribution of current as a function of height.

17. The antenna according to claim 1, wherein the varying pitch of said helical antenna results in an increase in radiation resistance and bandwidth of the antenna.

18. An antenna for a portable radio device, including a helical antenna coupled at its base to a transmitter/receiver, said antenna comprising:

a conductive material helix which includes: an upper portion having a pitch which varies according to the height of the helix, decreasing from a lower end of the upper portion to a top end of the upper portion, the electrical length of said upper portion being substantially equal to one quarter-wavelength; and a coaxial member including a central core and an outer conductor, said coaxial member extending from a base of said helix to the lower end of said upper portion of said helix and having an electrical length substantially equal to one quarter-wavelength, said core being connected to said upper portion of said helix and forming said helical antenna therewith, said coaxial member being connected to a feed coaxial cable of said helical antenna.

19. A portable radio device including an antenna for portable radio devices including a helical antenna coupled at its base to a transmitter/receiver, wherein the pitch of a conductive material helix constituting said helical antenna varies according to the height of the helix, decreasing from the base of said helical antenna to its top, said helical antenna being disposed in the top part of a casing of said device, wherein the electrical length of said helix is substantially equal to one quarter-wavelength.

20. A portable radio device including an antenna for portable radio devices including a helical antenna coupled at its base to a transmitter/receiver, wherein the pitch of a conductive material helix constituting said helical antenna varies according to the height of the helix, decreasing from the base of said helical antenna to its top, said helical antenna being disposed in the top part of a casing of said device, and a retractable whip being inserted in a housing which is part of said casing when retracted and emerging from the top part of said casing when deployed, wherein the electrical length of said helix is substantially equal to one quarter-wavelength.

* * * * *